US008414318B1

(12) United States Patent
Chen

(10) Patent No.: US 8,414,318 B1
(45) Date of Patent: Apr. 9, 2013

(54) POWER ADAPTER HAVING A PLUG MODULE MOUNTED ON A SUBSTRATE WITH MULTIPLE FASTENERS WITH CLASPS

(75) Inventor: Shen-Liang Chen, Xindian Dist. (TW)

(73) Assignee: Leader Electronics Inc., New Taipei (TW)

( * ) Notice: Subject to any disclaimer, the term of this patent is extended or adjusted under 35 U.S.C. 154(b) by 0 days.

(21) Appl. No.: 13/325,673

(22) Filed: Dec. 14, 2011

(51) Int. Cl.
*H01R 29/00* (2006.01)

(52) U.S. Cl.
USPC ..... 439/173

(58) Field of Classification Search ..... 439/171–173, 439/11–30, 52, 53
See application file for complete search history.

(56) References Cited

U.S. PATENT DOCUMENTS 6,749,451 B2 * 6/2004 Schmitt ..... 439/218
6,942,508 B2 * 9/2005 Wong ..... 439/171
7,168,969 B1 * 1/2007 Wang ..... 439/173
7,946,868 B1 * 5/2011 Chen ..... 439/173
8,079,877 B1 * 12/2011 Lai et al. ..... 439/655
2012/0178305 A1 * 7/2012 Chen ..... 439/660

* cited by examiner

*Primary Examiner* — Chandrika Prasad

(74) *Attorney, Agent, or Firm* — William E. Pelton, Esq.; Cooper & Dunham LLP

(57) ABSTRACT

A power adapter with a rotatable plug module has a body, a circuit module and a plug module. The body has multiple fasteners and multiple clasps. The fasteners are arranged in a ring shape. Each of the clasps is formed on one side of each fastener and extends from the fasteners in the same orientation. The circuit module has a circuit board mounted in the body. The plus module has multiple conducting blades and multiple holes. The holes are engaged with the fasteners of the substrate when the plug module is rotated to correspond to the fasteners. The conducting blades are electrically connected to the circuit board. Because the plug module is rotatable and can be removed from the body, the power adapter with suitable conducting pins is available to various sockets.

13 Claims, 11 Drawing Sheets

POWER ADAPTER HAVING A PLUG MODULE MOUNTED ON A SUBSTRATE WITH MULTIPLE FASTENERS WITH CLASPS

BACKGROUND OF THE INVENTION

1. Field of the Invention

The present invention relates to a power adapter, and more particularly to a power adapter with a rotatable plug module.

2. Description of Related Art

Nowadays, the electric appliances are widespread and diverse, such as notebooks, cell phones and MP3 players. A battery or a DC power provides an operating voltage to activate the electric appliances mentioned above. Therefore, the electric appliances often cooperate with a charger or a power conversion device. The charger or the power conversion device is connected to an AC power via a plug.

Generally, the plug is electrically connected to a socket mounted on a wall or an extension cord extending from the socket on the wall. In order to provide an operating DC power to activate the electric appliances or to charge the battery, an additional power adapter will be connected to a power line or be mounted in the socket. However, the additional power adapter will increase the cost and be inconvenient for storage. In another aspect, if the power adapter such as a buck circuit or a rectifying circuit is incorporated into the plugs, the plug will become very bulky. Moreover, when conducting pins are firmly mounted on the plug at a certain angle, the plug may block the jacks of the rest of the sockets due to its bulky size and cause the rest of the sockets to be unavailable.

SUMMARY OF THE INVENTION

An objective of the present invention is to provide a power adapter with a rotatable plug module.

To achieve the foregoing objective, the power adapter with a rotatable plug module comprises a body, a circuit module and a plug module.

The body comprises a shell and a substrate. The shell has a front opening. The substrate has multiple fasteners and multiple clasps. The fasteners are arranged in a ring shape. Each of the clasps is formed on one side of each fastener and all the clasps extend from the fasteners in the same orientation.

The circuit module comprises a circuit board mounted in the shell.

The plug module comprises a base, a front cover and multiple conducting blades. The base has multiple holes and multiple ribs. The multiple holes are engaged with the fasteners of the substrate when the plug module is rotated to correspond to the fasteners. The multiple ribs are formed between two adjacent holes respectively. The front cover is securely mounted on a front surface of the base and has multiple slots. The multiple conducting blades are securely inserted into the front cover and electrically connected to the circuit board.

The plug module is rotatable and can be removed from the body. Therefore, the power adapter in accordance with the present invention is available to the sockets by changing the conducting blades that are suitable to the sockets. Moreover, the plug module can be rotated to a suitable position where the body does not block the rest of the sockets.

DETAILED DESCRIPTION OF THE PREFERRED EMBODIMENT

Figure 1:
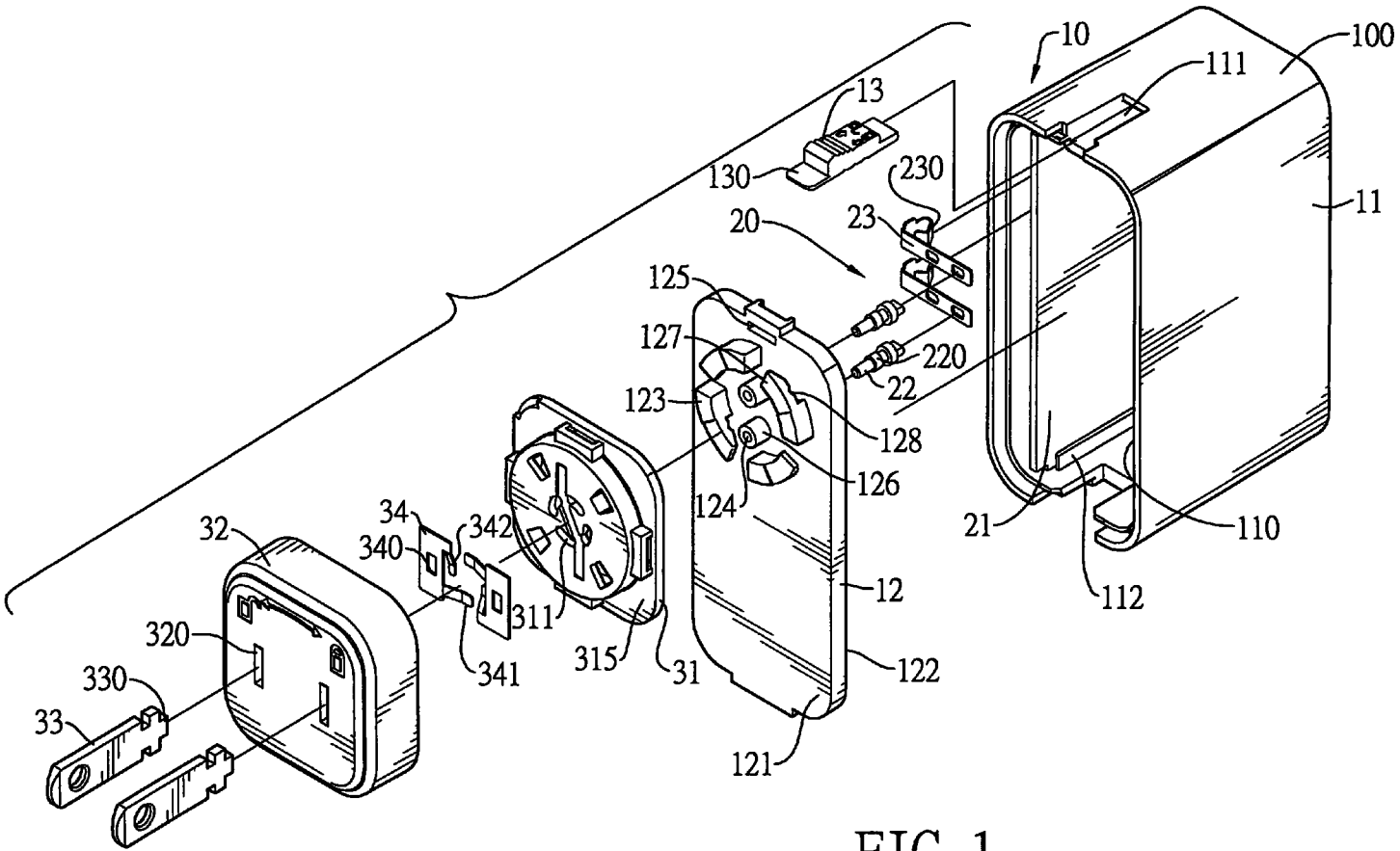
FIG. 1 is an exploded perspective view of a first embodiment of a power adapter with a rotatable plug module in accordance with the present invention.
Figure 2:
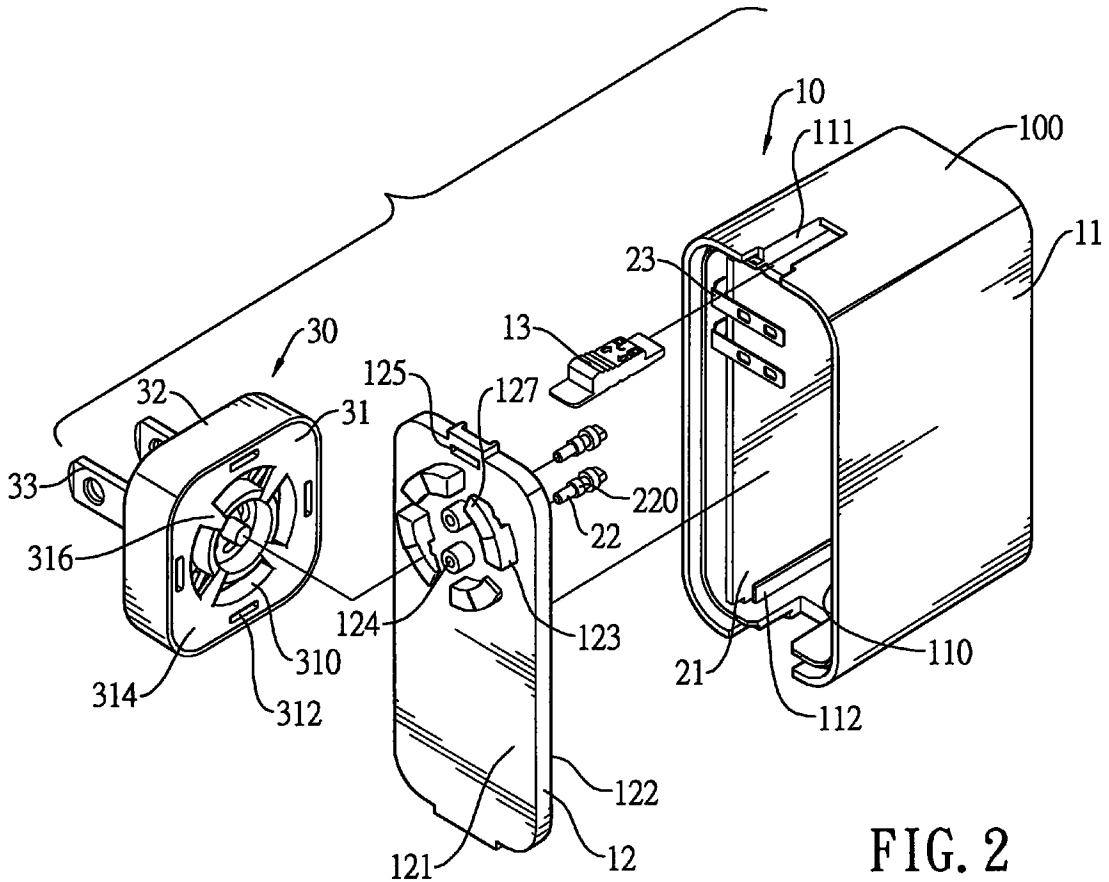
FIG. 2 is an exploded perspective view in partial section of the power adapter of the first embodiment.

With reference to FIG. 1 and FIG. 2, a first embodiment of a power adapter with a rotatable plug has a body 10, a circuit module 20 and a plug module 30.

The body 10 has a shell 11, a substrate 12 and a release tongue 13. The shell 11 is hollow and has a top surface 100, a front opening 110 and a track 111 formed on the top surface 100 near the front opening 110. The substrate 12 is mounted in the front opening 110 and has a front surface 121 and a rear surface 122. Four fasteners 123, two through holes 124 and a through groove 125 are formed on the substrate 12. The four fasteners 123 are arranged in a ring shape on the front surface 121 of the substrate 12. The through holes 124 are formed through the substrate 12 among the fasteners 123. The through groove 125 is formed through the substrate 12 and corresponds to the track 111. In this embodiment, the through holes 124 are formed in two tubes 126 protruding from the front surface 121 of the substrate 12 respectively. A clasp 127 is formed on one side of each fastener 123. All the clasps 127 extend from the respective fasteners 123 in the same orientation, for example, in an anti-clockwise direction. Each clasp 127 is separated from the front surface 121 of the substrate 12 by a gap and has an engagement groove 128 formed on an inner surface of the clasp 127 toward the front surface 121. The release tongue 13 is slidably mounted in the track 111 and has a terminal 130 extending through the through groove 125.

Figure 3:
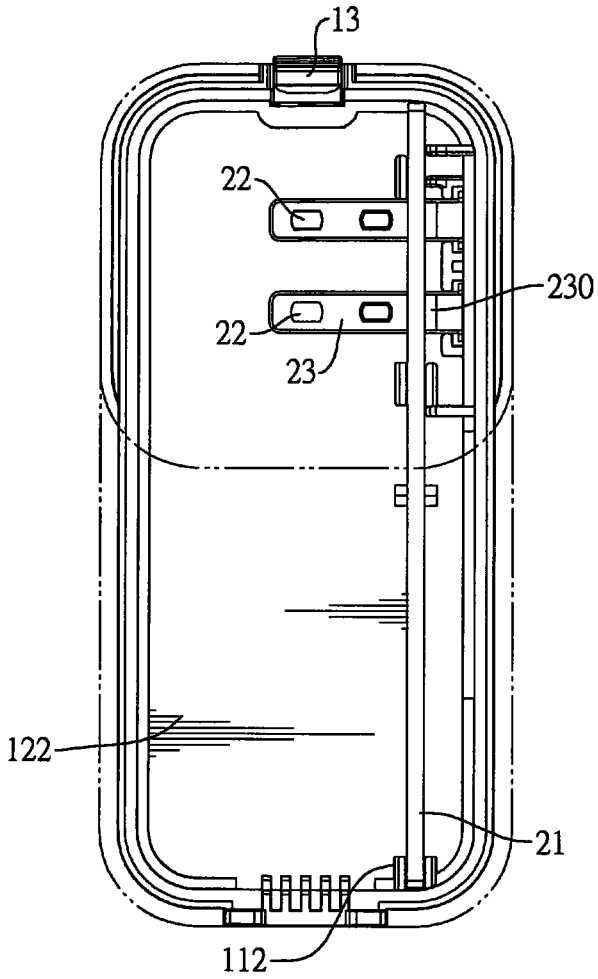
FIG. 3 is a hack view in partial section of the power adapter of the first embodiment.

The circuit module 20 comprises a circuit board 21 and two conductive pins 22. The circuit board 21 is mounted in the body 10. In this embodiment, flanges 112 are formed in two opposite inner surfaces of the shell 11 and the circuit board 21 is held by the flanges 112. The two conductive pins 22 are mounted through the two through holes 124 respectively and can protrude from the tubes 126 in the front surface 121 of the substrate 12. With reference to FIG. 3, two conductors 23 are electrically connected between the circuit board 21 and the conductive pins 22. Each of the conductors 23 has a hook 230 that is electrically connected to the circuit board 21 and contacts the conductive pin 22 in the through holes 124. Each of the conductive pins 22 has an enlarged section 220 larger than the through hole 124 in diameter. Therefore, the conductive pins 22 will be secured in the through holes 124 and the conductors 23 will make an electric connection between the circuit board 21 and the conductive pins 22.

Figure 4:
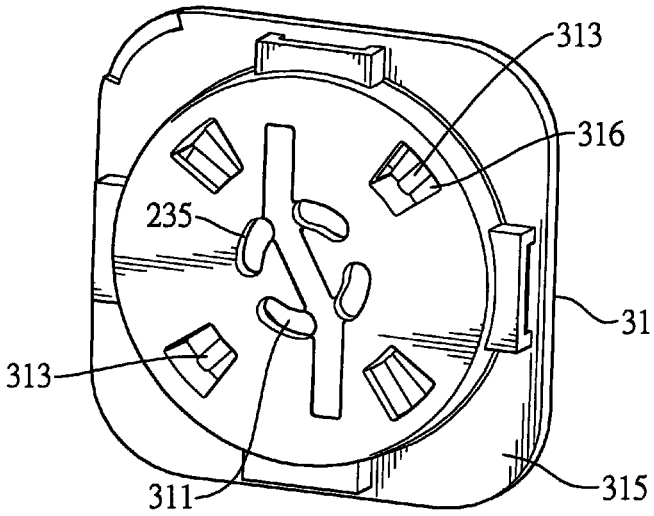
FIG. 4 is a perspective view of the base of the plug module of the first embodiment.

The plug module 30 has a base 31, a front cover 32, two conducting blades 33 and two conducting pieces 34. The base 31 has four holes 310, four apertures 311 and four slots 312. The holes 310 are formed in a rear surface 314 of the base 31 and arranged in a ring shape corresponding to the fasteners 123 of the substrate 12, wherein a rib 316 is formed between two adjacent holes 310. Each of the ribs 316 has a front surface formed toward the conducting blades 33. The apertures 311 are formed among the holes 310 to correspond to the through holes 124 of the substrate 12. The slots 312 of the base 31 are formed near the holes 310 respectively. With reference to FIG. 4, four protrusions 313 are respectively formed on the front surface of the ribs 316. The front cover 32 is securely mounted on a front surface 315 of the base 31 and has two slots 320. Each of the conducting pieces 34 is behind the front cover 32 and has a through slot 340, a first rib 341 and a second rib 342. A back terminal 330 of each conducting blade 33 is inserted into the slot 320 of the front cover 32 and electrically engaged in the through slot 340 of the corresponding conducting piece 34.

Figure 5:
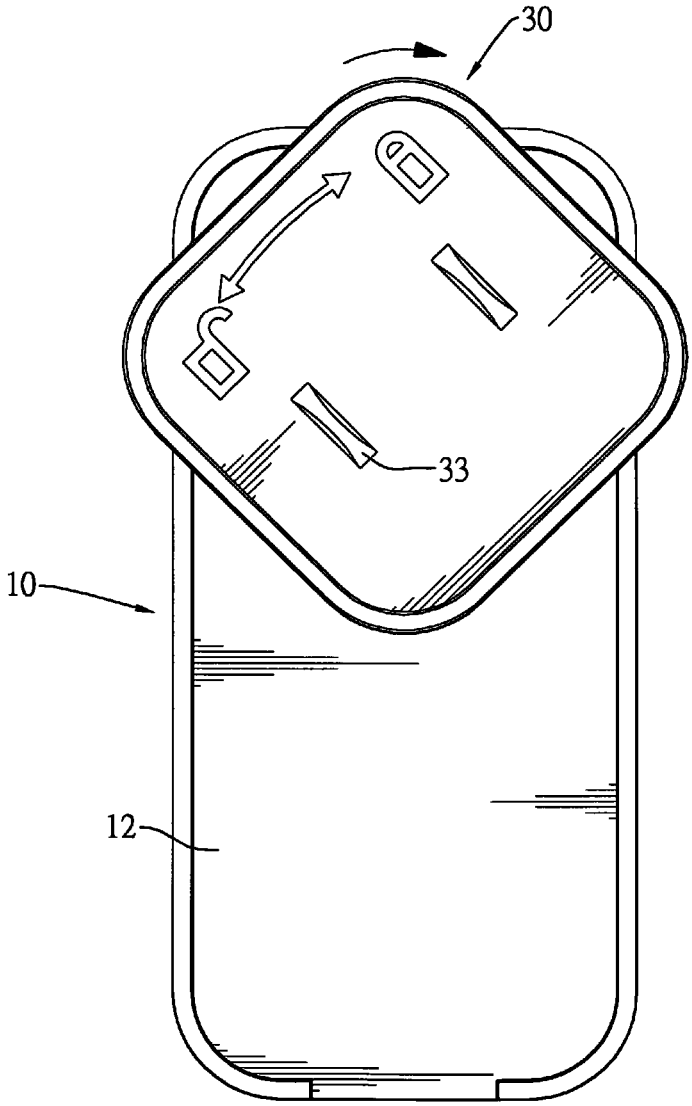
FIG. 5 and FIG. 6 are operating views of the power adapter of the first embodiment.
Figure 6:
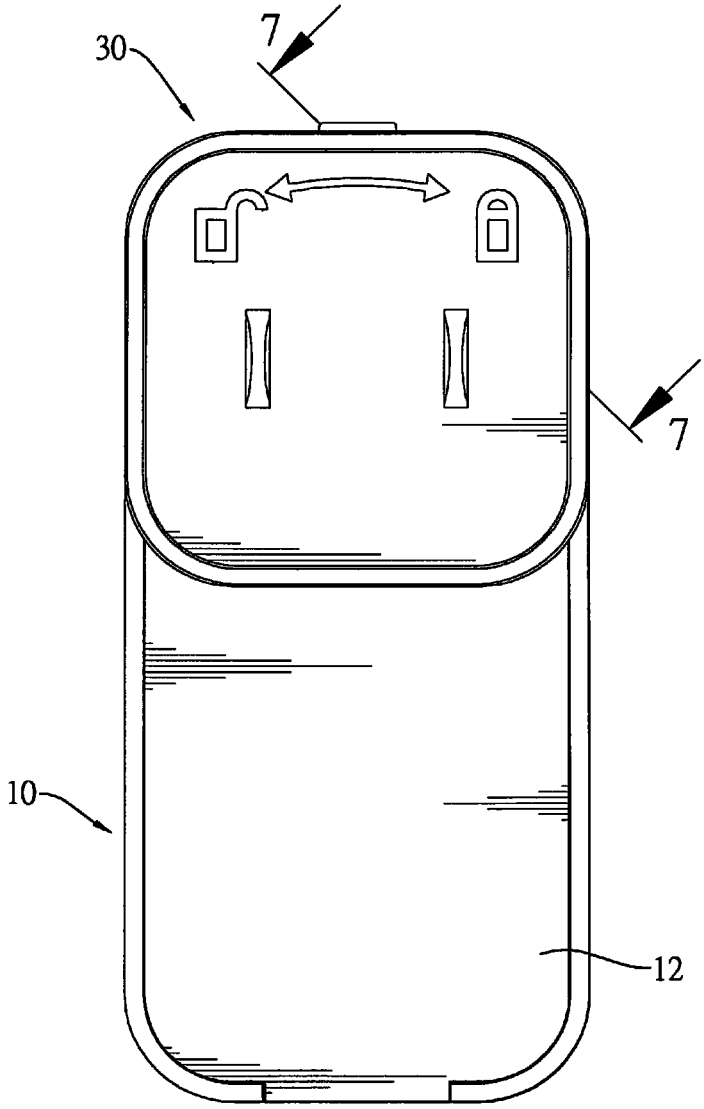
Figure 7:
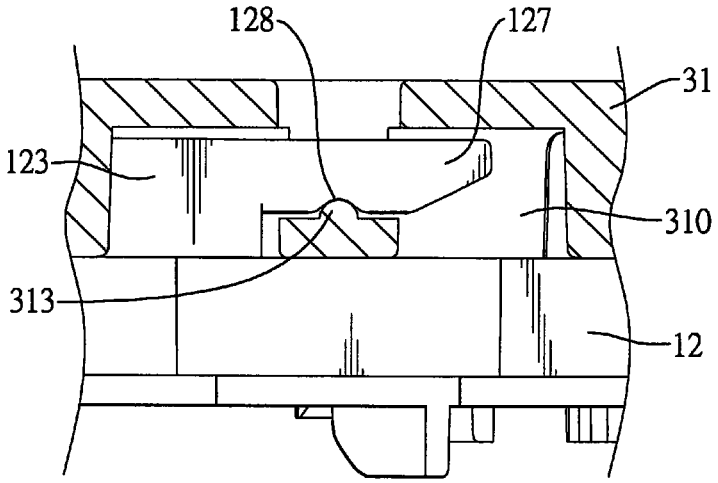
FIG. 7 is an enlarged cross-sectional view in partial section of the power adapter of the first embodiment.

The plug module 30 is assembled with the body 10 when the fasteners 123 are securely mounted in the holes 310 respectively. First of all, the fasteners 123 are set in the holes 310 and the tubes 126 are inserted into the apertures 311 respectively. With reference to FIG. 5 and FIG. 6, as the plug module 30 rotates against the body 10 clockwise, each clasp 127 slides toward a corresponding protrusion 313. The tubes 126 of the substrate 12 extend through the apertures 311, too. With reference to FIG. 7, after rotating, the protrusions 313 are engaged in the engagement grooves 128 respectively.

Figure 8A:
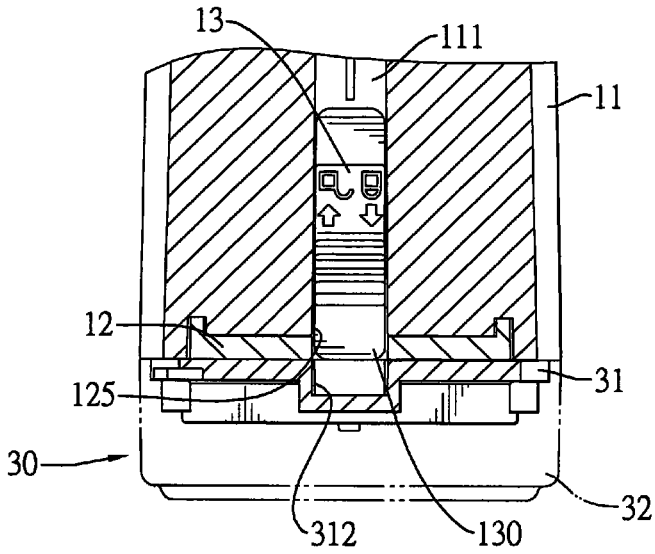
FIGS. 8A and 8B are operating views showing that the release tongue is pushed toward the plug module.
Figure 8B:
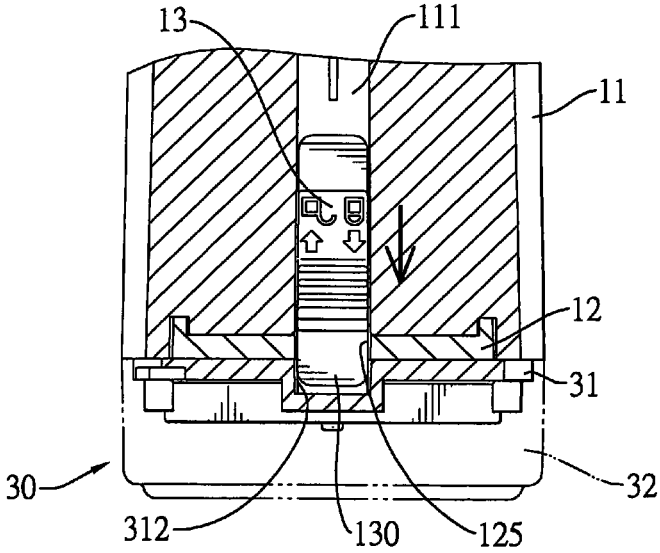
Figure 9:
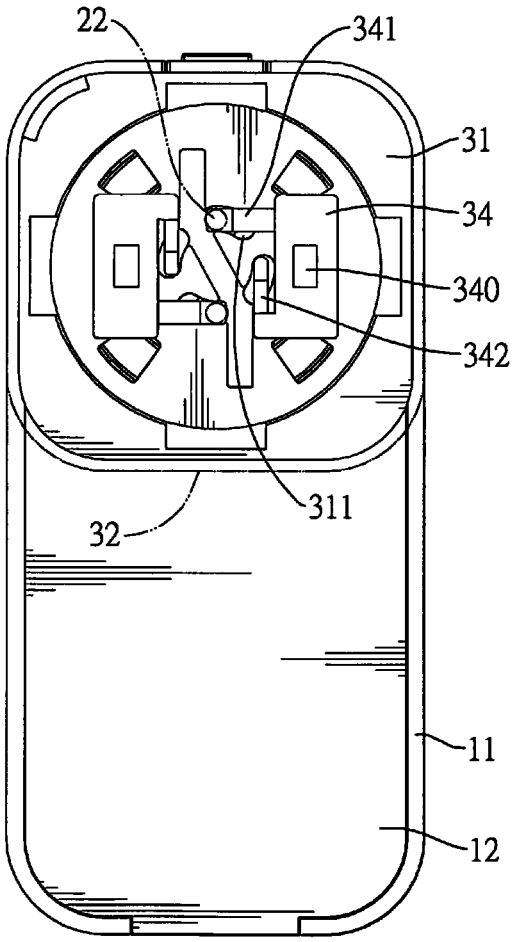
FIG. 9 is a front view in partial section of the plug module.

With reference to FIGS. 8A and 8B, the release tongue 13 can be pushed toward the slot 312 of the base 31. The terminal 130 of the release tongue 13 passes through the through groove 125 and then is inserted into the slot 312 of the base 31. As a result, the plug module 30 assembles with the body 10 securely. Meanwhile, with reference to FIG. 9, the first ribs 341 of the conducting pieces 34 contact the conductive pins 22 respectively. Therefore, the circuit board 21 is electrically connected to the conducting blades 33.

The plug module 30 can be disassembled from the body 10 by the following steps:

1. Push the release tongue 13 backward the plug module 30.
2. Rotate the plug module 30 counter-clockwise against the body 10 to unlock the fasteners 123 from the holes 310.

Figure 10:
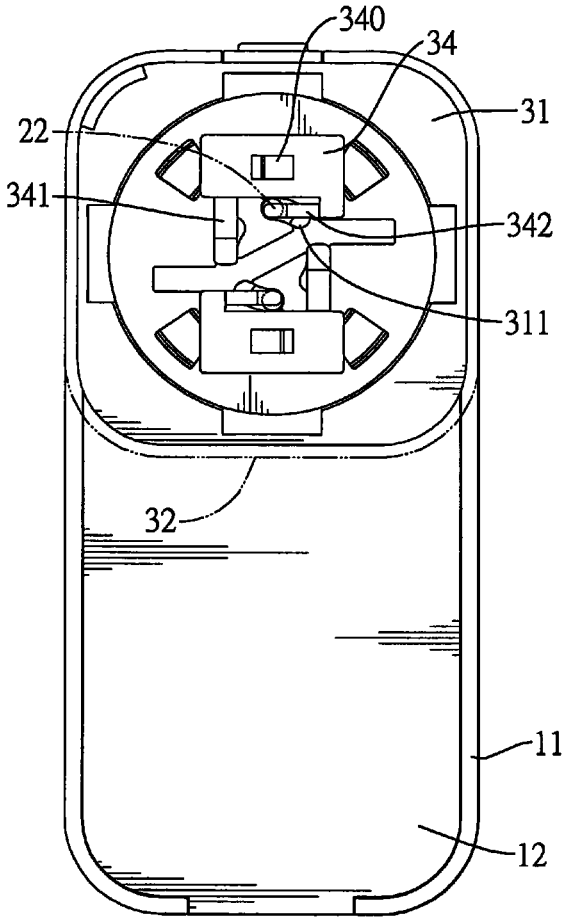
FIG. 10 is a front view in partial section of the plug module.

After disassembling the plug module 30 and the body 10, if the orientation of the plug module 30 is desired to change, the fasteners 123 of the substrate 12 can be put in the subsequent holes 310 of the base 31. Then the plug module 30 can be rotated against the body 10 clockwise until the protrusions 313 of the base 31 are engaged in the engagement grooves 128 of the fasteners 123. With reference to FIG. 10, after rotating, the second ribs 342 of the conducting pieces 34 contact the conductive pins 22 to be electrically connected to the circuit board 21.

Figure 11A:
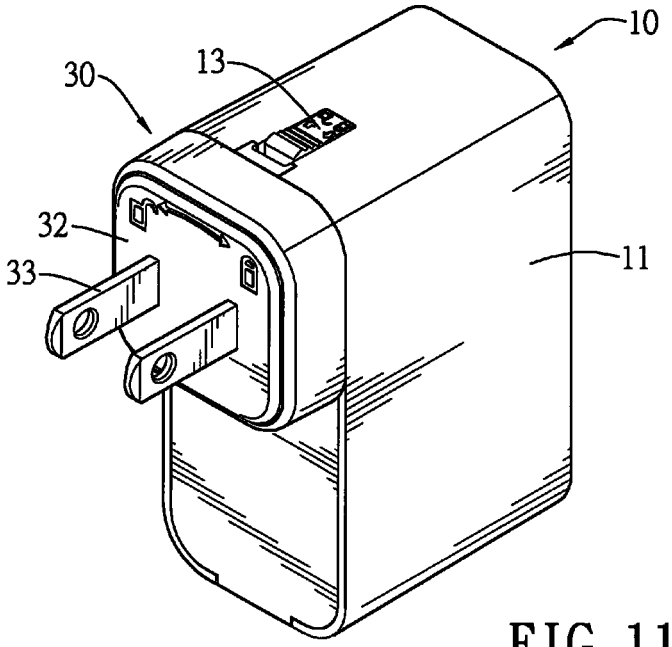
FIGS. 11A and 11B are perspective views showing that the plug module are in different positions.
Figure 11B:
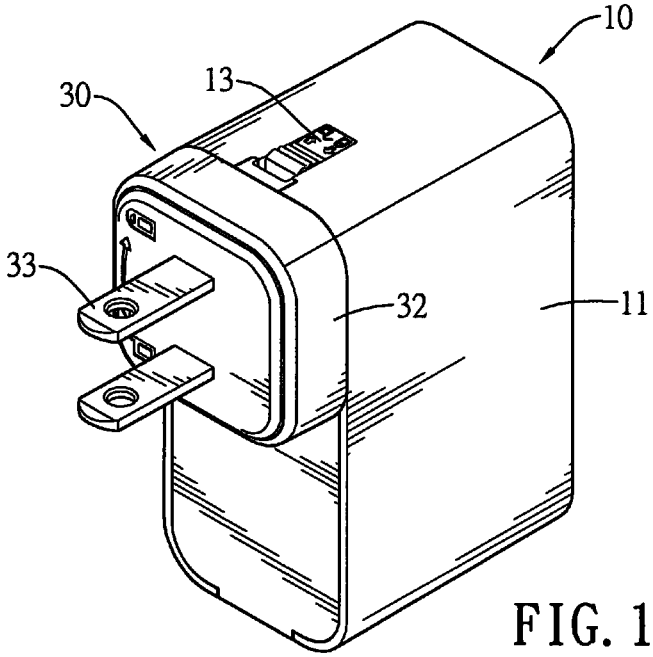

With reference to FIG. 11A and FIG. 11B, the plug module 30 is mounted on the body 10 in different orientations in this embodiment in accordance with the present invention and users can make use of any of the orientations. Therefore, if the plug module is plugged in a socket and at a suitable position, the body of the power adapter will not block the rest of the sockets.

Because the plug module 30 is rotatable and can be removed from the body 10, by changing a certain plug module 30 with suitable conducting blades 33, the power adapter is available to all sockets universally. For example, the conducting blades 33 are cylindrical in Europe; in contrast, the conducting blades 33 are flat in Taiwan. Therefore, if a user has various types of plug modules 30, the user can use the power adapter in any country by changing a corresponding plug module 30.

What is claimed is:

1. A power adapter with a rotatable plug module comprising:

a body comprising
- a shell having a front opening; and
- a substrate mounted in the front opening and having
  - a top surface;
  - a front surface;
  - a rear surface;
  - multiple fasteners formed on the front surface of the substrate and arranged in a ring shape; and
  - multiple clasps, each of the clasps formed on one side of each fastener and all the clasps extending from the fasteners in the same orientation;

a circuit module comprising a circuit board mounted in the shell; and a plug module detachably mounted on the substrate and comprising
- a base having
  - a front surface;
  - a rear surface;
  - multiple holes formed in the rear surface of the base and to be engaged with the fasteners of the substrate when the plug module is rotated to correspond to the fasteners; and
  - multiple ribs formed between two adjacent holes respectively;
- a front cover securely mounted on the front surface of the base; and
- multiple conducting blades securely inserted into the front cover and electrically connected to the circuit board.

2. The power adapter as claimed in claim 1, wherein multiple through holes are formed among the fasteners of the substrate;

multiple apertures are formed among the holes of the base and correspond to the through holes of the substrate;

two conductive pins are mounted through and protrude from the through holes of the substrate and are electrically connected to the circuit board and the conducting blades;

multiple slots are formed on the front cover and are applied to mount the conducting blades; and multiple conducting pieces are mounted between the front cover and the base, each conducting piece having
- a through slot applied to securely engage a back terminal of one conducting blade;
- a first rib contacting one of the conductive pins; and
- a second rib contacting the other of the conductive pins.

3. The power adapter as claimed in claim 2, wherein a track is formed on the shell near the front opening;

a through groove is formed through the substrate and corresponds to the track;

multiple slots are formed near the holes of the base respectively; and a release tongue is slidably mounted in the track and has a terminal extending through the through groove to be inserted into one of the slots of the base.

4. The power adapter as claimed in claim 2, wherein multiple flanges are formed in two opposite inner surfaces of the shell to hold the circuit board.

5. The power adapter as claimed in claim 3, wherein multiple flanges are formed in two opposite inner surfaces of the shell to hold the circuit board.

6. The power adapter as claimed in claim 4, wherein multiple conductors are mounted between the circuit board and the conductive pins respectively; each conductor blocks the conductive pin in the through hole of the substrate and has a hook electrically connected to the circuit board; and each conductive pin has an enlarged section larger than the through hole of the substrate in diameter.

7. The power adapter as claimed in claim 5, wherein multiple conductors are mounted between the circuit board and the conductive pins respectively; each conductor blocks the conductive pin in the through hole of the substrate and has a hook electrically connected to the circuit board; and each conductive pin has an enlarged section larger than the through hole of the substrate in diameter.

8. The power adapter as claimed in claim 6, wherein multiple tubes are formed on the substrate and the through holes of the substrate are formed in the tubes respectively; and the tubes are inserted into the apertures of the base respectively.

9. The power adapter as claimed in claim 7, wherein multiple tubes are formed on the substrate and the through holes of the substrate are formed in the tubes respectively; and the tubes are inserted into the apertures of the base respectively.

10. The power adapter as claimed in claim 8, wherein each clasp is separated from the front surface of the substrate and has an engagement groove; and multiple protrusions are respectively formed on the ribs of the base to engage with the engagement grooves of the clasps.

11. The power adapter as claimed in claim 9, wherein each clasp is separated from the front surface of the substrate and has an engagement groove; and multiple protrusions are respectively formed on the ribs of the base to engage with the engagement grooves of the clasps.

12. The power adapter as claimed in claim 10, wherein the body comprises four fasteners, four clasps and two through holes;

the circuit module comprises two conductive pins; and the plug module comprises four holes and four apertures.

13. The power adapter as claimed in claim 11, wherein the body comprises four fasteners, four clasps and two through holes;

the circuit module comprises two conductive pins; and the plug module comprises four holes and four apertures.

* * * * *